US006672046B1

(12) United States Patent
Prewo et al.

(10) Patent No.: US 6,672,046 B1
(45) Date of Patent: Jan. 6, 2004

(54) TENSION MEMBER FOR AN ELEVATOR

(75) Inventors: Karl M. Prewo, Vernon, CT (US); Mark S. Thompson, Tolland, CT (US); Pedro S. Baranda, Mexico (MX); David C. Jarmon, Kensington, CT (US)

(73) Assignee: Otis Elevator Company, Farmington, CT (US)

( * ) Notice: Subject to any disclaimer, the term of this patent is extended or adjusted under 35 U.S.C. 154(b) by 58 days.

(21) Appl. No.: 09/642,347

(22) Filed: Aug. 21, 2000

Related U.S. Application Data

(60) Provisional application No. 60/150,877, filed on Aug. 26, 1999.

(51) Int. Cl.[7] ..... D02G 3/32
(52) U.S. Cl. ..... 57/232; 57/238; 57/241
(58) Field of Search ..... 57/200, 210–212, 57/217, 218, 221–223, 231, 232, 236–238, 241, 258; 174/113 R, 117 R, 117 F

(56) References Cited

U.S. PATENT DOCUMENTS

| | | | | | |
|---|---|---|---|---|---|
| 3,618,309 | A | * | 11/1971 | Walsh | 57/217 |
| 4,227,041 | A | * | 10/1980 | Den et al. | 174/117 F |
| 4,445,593 | A | * | 5/1984 | Coleman et al. | 187/413 |
| 4,724,929 | A | * | 2/1988 | Coleman et al. | 187/411 |
| 4,861,947 | A | * | 8/1989 | Altermatt et al. | 174/113 C |
| 5,354,210 | A | * | 10/1994 | Koblitz et al. | 439/276 |
| 6,295,799 | B1 | * | 10/2001 | Baranda | 57/221 |
| 6,364,063 | B1 | * | 4/2002 | Aulanko et al. | 187/266 |
| 6,508,051 | B1 | * | 1/2003 | De Angelis | 57/223 |

FOREIGN PATENT DOCUMENTS

| | | | | | |
|---|---|---|---|---|---|
| GB | 1362513 | A | * | 8/1974 | B32B/5/28 |
| WO | WO 200114630 | A1 | * | 3/2001 | D07B/1/00 |

* cited by examiner

*Primary Examiner*—John J. Calvert
*Assistant Examiner*—Shaun R Hurley

(57) ABSTRACT

A hybrid material tension member for an elevator or other people transportation system using organic fiber and steel material as the load carrying components either discretely or in combined form. Several embodiments are disclosed.

8 Claims, 3 Drawing Sheets

TENSION MEMBER FOR AN ELEVATOR

This application claims the benefit of U.S. Provisional Application No. 60/150,877, filed Aug. 26, 1999.

TECHNICAL FIELD

The present invention relates to elevator systems, and more particularly to tension members for such elevator systems.

BACKGROUND OF THE INVENTION

A conventional traction elevator system includes a car, a counterweight, two or more ropes interconnecting the car and counterweight, a traction sheave to move the ropes, and a machine to rotate the traction sheave. The ropes are formed from laid or twisted steel wire and the sheave is formed from cast iron. The machine may be either a geared or gearless machine. A geared machine permits the use of higher speed motor, which is more compact and less costly, but requires additional maintenance and space.

Although conventional round steel ropes and cast iron sheaves have proven very reliable and cost effective, there are limitations on their use. One such limitation is the traction forces between the ropes and the sheave. These traction forces may be enhanced by increasing the wrap angle of the ropes or by undercutting the grooves in the sheave. Both techniques reduce the durability of the ropes, however, as a result of the increased wear (wrap angle) or the increased rope pressure (undercutting). Another method to increase the traction forces is to use liners formed from a synthetic material in the grooves of the sheave. The liners increase the coefficient of friction between the ropes and sheave while at the same time minimizing the wear of the ropes and sheave.

Another limitation on the use of round steel ropes is the flexibility and fatigue characteristics of round steel wire ropes. Elevator safety codes today require that each steel rope have a minimum diameter d ($d_{min}$=8 mm for CEN; $d_{min}$=9.5 mm (⅜") for ANSI) and that the D/d ratio for traction elevators be greater than or equal to forty ($D/d \geqq 40$), where D is the diameter of the sheave. This results in the diameter D for the sheave being at least 320 mm (380 mm for ANSI). The larger the sheave diameter D, the greater torque required from the machine to drive the elevator system.

Another drawback of conventional round ropes is that the higher the rope pressure, the shorter the life of the rope. Rope pressure ($P_{rope}$) is generated as the rope travels over the sheave and is directly proportional to the tension (F) in the rope and inversely proportional to the sheave diameter D and the rope diameter d ($P_{rope} \approx F/(Dd)$. In addition, the shape of the sheave grooves, including such traction enhancing techniques as undercutting the sheave grooves, further increases the maximum rope pressure to which the rope is subjected.

The above art notwithstanding, scientists and engineers under the direction of Applicants' Assignee are working to develop more efficient and durable methods and apparatus to drive elevator systems.

DISCLOSURE OF THE INVENTION

According to the present invention, a tension member for an elevator has an aspect ratio of greater than one, where aspect ratio is defined as the ratio of tension member width w to thickness t (Aspect Ratio=w/t).

A principal feature of the present invention is the flatness of the tension member. The increase in aspect ratio results in a tension member that has an engagement surface, defined by the width dimension, that is optimized to distribute the rope pressure. Therefore, the maximum pressure is minimized within the tension member. In addition, by increasing the aspect ratio relative to a round rope, which has an aspect ratio equal to one, the thickness of the tension member may be reduced while maintaining a constant cross-sectional area of the tension member.

According further to the present invention, the tension member includes a plurality of individual load carrying cords, strands and/or wires encased within a common layer of coating. The coating layer separates the individual cords, strands and/or wires and defines an engagement surface for engaging a traction sheave.

Due to the configuration of the tension member, the rope pressure may be distributed more uniformly throughout the tension member. As a result, the maximum rope pressure is significantly reduced as compared to a conventionally roped elevator having a similar load carrying capacity. Furthermore, the effective rope diameter 'd' (measured in the bending direction) is reduced for the equivalent load bearing capacity. Therefore, smaller values for the sheave diameter 'D' may be attained without a reduction in the D/d ratio. In addition, minimizing the diameter D of the sheave permits the use of less costly, more compact, high speed motors as the drive machine without the need for a gearbox.

The cords, strands and/or wires in the tension member of the invention are preferably steel and organic fiber in a number of combinations. The two materials may be maintained separately and comprise distinct steel cords and organic fiber cords in the common jacket; the two materials may be combined into a single cord, a plurality of which cords are dispersed in the common jacket; the materials may be wrapped one around the other in ordered arrays within the common jacket; and the organic fibers may be randomly dispersed in the common jacket with steel cords being also dispersed therein.

Each of the combinations noted provides a hybrid flexible flat tension member having strengths and advantages not available in steel cord flat tension members or organic fiber flat tension members. Advantages of each material individually include for steel: nondestructive examination capabilities; high heat resistance; low stretch. And for organic fiber: low weight and high strength; not susceptible to corrosion. Creating a tension member that effectively employs both steel and organic fibers where load is shared between the two provides a tension member having significantly enhanced properties. The present invention provides several embodiments which allow the two materials to "share-the-load" which requires consideration of load carrying capability of each of the types of material; the long term bending fatigue resistance of the individual materials; the stretch of each material and belt tracking stability achieve such synergistic benefits.

The foregoing and other objects, features and advantages of the present invention become more apparent in light of the following detailed description of the exemplary embodiments thereof, as illustrated in the accompanying drawings.

BRIEF DESCRIPTION OF THE DRAWINGS

Referring now to the drawings wherein like elements are numbered alike in the several FIGURES.

BEST MODE FOR CARRYING OUT THE INVENTION

Figure 1:
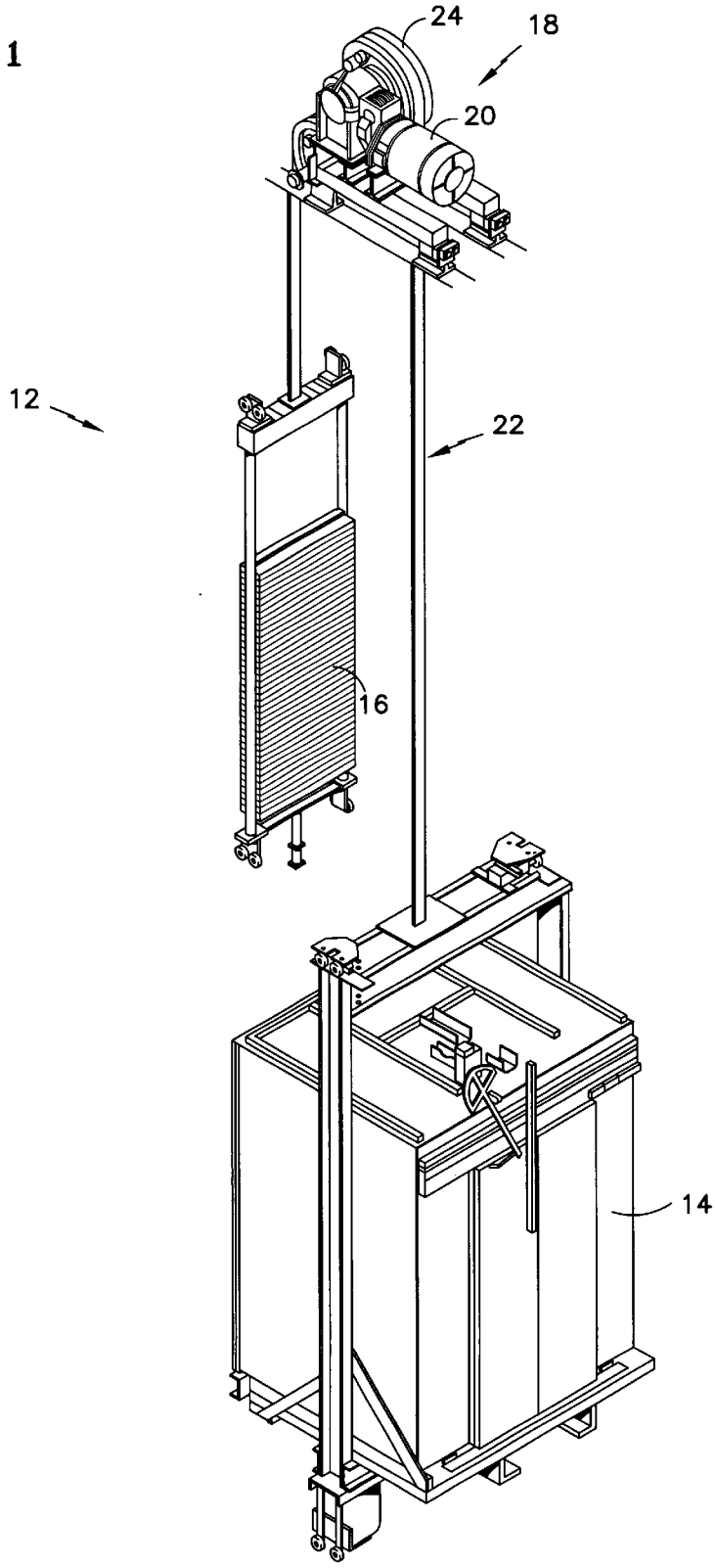
FIG. 1 is perspective view of an elevator system having a traction drive within which the tension member of the invention functions.

Illustrated in FIG. 1 is a traction elevator system 12. The elevator system 12 includes a car 14, a counterweight 16, a traction drive 18, and a machine 20. The traction drive 18 includes a tension member 22, interconnecting the car 14 and counterweight 16, and a traction sheave 24. The tension member 22 is engaged with the sheave 24 such that rotation of the sheave 24 moves the tension member 22, and thereby the car 14 and counterweight 16. The machine 20 is engaged with the sheave 24 to rotate the sheave 24. Although shown as a geared machine 20, it should be noted that this configuration is for illustrative purposes only, and the present invention may be used with geared or gearless machines.

The invention provides hybrid material flexible flat tension members having superior properties to single material flexible flat tension members. It should be noted that all possible mixtures of the load carrying material do not provide a synergistic result in the tension member created. Rather, careful analysis of structural load carrying capacity is required to balance the load applied between the types of load carrying materials and obtain superior characteristics as well as excellent tension member tracking stability.

Figure 2:
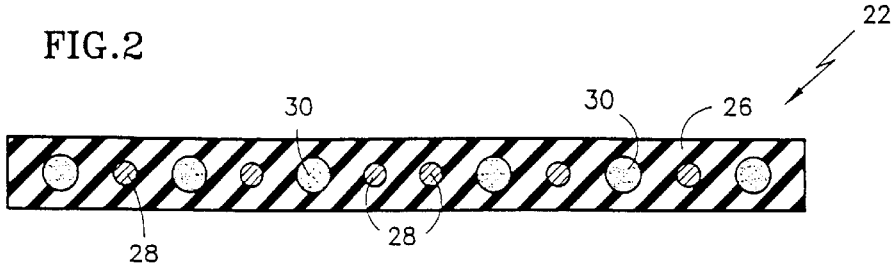
FIG. 2 is a schematic cross section of a first embodiment of a hybrid flexible flat tension member of the invention.

Referring to FIG. 2, a first embodiment of a hybrid flexible flat tension member of the invention is illustrated schematically in cross section. Tension member 22 comprises a common urethane or other polymeric jacket 26. Steel load carrying material is located in areas marked 28 while organic load carrying material is identified as 30. As one of ordinary skill in the art will appreciate the load carrying material is relatively evenly spaced over the width of tension member 22. It is preferable to provide two side-by-side steel cords 28 at a central location in the tension member 22 to balance tracking side-to-side. Symmetry is important on either side of a longitudinal centerline of the tension member to ensure stable tracking of the tension member on a sheave.

The organic fibers 30 are illustrated as having a larger cross section than the steel cords 28 but this is not required. Rather the question is what weight rating is desired and what heat resistance is desired as well as similar parameters. Mathematical calculation, which is within the level of skill of one of ordinary skill in the art to conduct, is then carried out to determine the amount of organic fiber to be used and the amount of steel cord to be used. The calculations are employed to ensure that the load will be shared among the various cords in the flat tension member allowing the benefits and properties of each to be utilized. It is also important that the axial stiffness of the tension member be such that at any given applied load, both types of cords share in the elastic response of the tension member. The twist and construction of these two cord types can be chosen to enable this load sharing. The cords themselves are not restricted in size, number or distribution (other than for tracking) to enable this result nor is it required that an equal number of organic fiber cords and steel cords be employed. What is important is that the characteristics of the two cord types be balanced with respect to the desired properties of the tension member so that those desired properties may be achieved. More than one way of laying out the cords and dimensions, etc. is possible for each desired result. It is noted that distribution is important to facilitate a tracking aspect of the tension member and one of the more easily accomplished distribution schemes for proper tracking is an even distribution of cord types across an axial centerline of the tension member.

One parameter that it is preferred to control is bending. It is preferable for steel cords to fail before organic cords in bending so that nondestructive examination methods may be employed to determine the integrity of the tension member. Such methods include electrical resistance or magnetic flux leakage.

Figure 3:
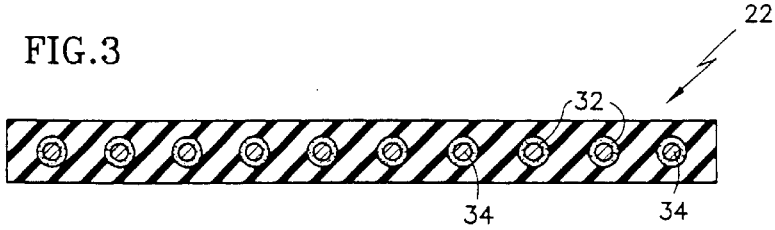
FIG. 3 is a schematic cross section of a second embodiment of a hybrid flexible flat tension member of the invention.

In another embodiment of the invention, referring to FIG. 3, each cord of the tension member 22 is hybrid in nature. Depicted is a tension member in cross section where an organic fiber material is located in an annulus 32 around a core 34 of steel. Although the tension member is illustrated with material types only one way it is to be understood that the organic fiber material may make up the core while steel is used for the annulus. It should also be appreciated that all of the cords used in the embodiment need not employ the same core material. One or more of the cords may employ steel as core 34 while one or more other cords may employ organic fiber as core 34. The twist and construction of each cord at the level of the annulus and the level of the core will affect the properties of the total tension member and this must be taken into account. One of ordinary skill in the art is aware of how to calculate the various possible twists and construction to arrive at the desired properties of the entire tension member. The degree to which elastomer penetration is desired into the individual cords should also be considered with respect to the location and size of cords employed. Where selected locations for cords involve cord-to-cord contact, fretting must be considered. In a preferred construction for this embodiment "s" and "z" cord constructions in equal numbers across the axial centerline of the tension member are employed.

Figure 4:
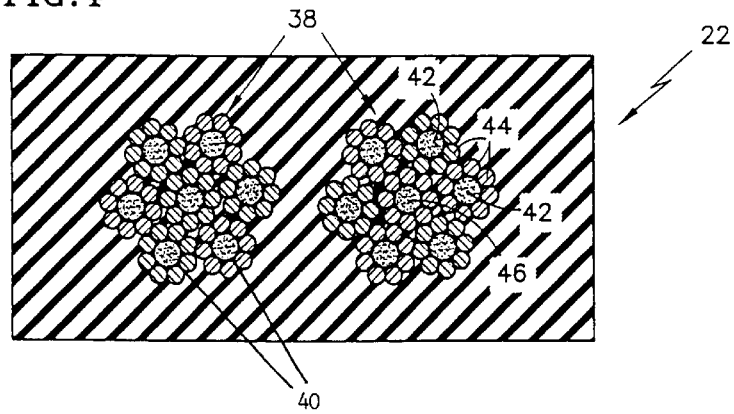
FIG. 4 is a schematic cross section of a third embodiment of a hybrid flexible flat tension member of the invention.

In FIG. 4 of the invention another alternate embodiment is illustrated. The figure is an enlarged view of only two cords 38 to illustrate the makeup of each cord. In this embodiment, each cord 38 is composed of several strands e.g. seven (six around one) and each strand is hybrid in nature. The strands 40 in the drawing are illustrated as having an organic center fiber 42 and eight steel wires 44 positioned therearound. Six of these strands are then positioned around a center strand 46 to form a hybrid cord 38. It will be understood that the positioning of the steel wires 44 and the organic fibers 42 could be reversed. Similar calculations must be made for this embodiment as are noted in the foregoing embodiments, such calculations being within the level of skill of the ordinary skill artisan. Hybrid cords are also beneficial in that the particular makeup of the cords can vary for specific purposes. For example, where a crowned sheave (not shown) will be used with a particular elevator system with which the tension member will be used to improve tracking, the cords that ride near or directly over the crown will be loaded more highly than other cords in the tension member. The hybrid cords can be tailored to handle the higher loading.

Figure 5:
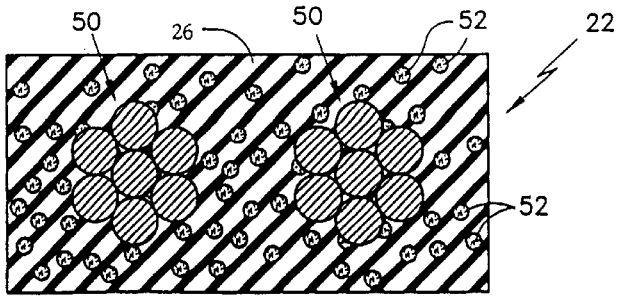
FIG. 5 is a schematic cross section of a fourth embodiment of a hybrid flexible flat tension member of the invention.

Referring now to FIG. 5, yet another embodiment of the invention is illustrated. FIG. 5 is an enlarged view showing only two cords. It will be understood that the embodiment may contain more cords. In this embodiment steel cords 50 having preferably seven wires each in a pattern of six around one are provided by themselves and are not directly hybrid cords. Rather the tension member 22 is hybrid as it includes, in the common coating material 28 which surrounds the cords, individual organic fibers 52. Fibers 52 are preferably oriented in parallel to the tension member major axis and are distributed throughout material 28. The stiffness of the steel cords 50 of this embodiment is controlled by the stiffness of the steel wires while organic fibers provide their own stiffness. Material 28 in this embodiment is preferably, as it is in the foregoing embodiments, composed of polyurethane.

For all of the embodiments described hereinabove the elastic modulus of the tension member can be increased by increasing the volume percent of steel used therein. As one of skill in the art will recognize, modulus calculations are based upon the "rule of mixtures", to wit:

$$E_{11}=U_{f1}E_{11f1}+V_{f2}E_{11f2}+V_mE_m$$

Where:

$E_{11}$=Longitudinal FFR modulus $E_{11f1}$=fiber 1 longitudinal modulus $E_{11f2}$=fiber 2 longitudinal modulus $E_m$=matrix modulus $V_{f1}$=volume percent fiber 1

$V_{f2}$=volume percent fiber 2

Figure 6:
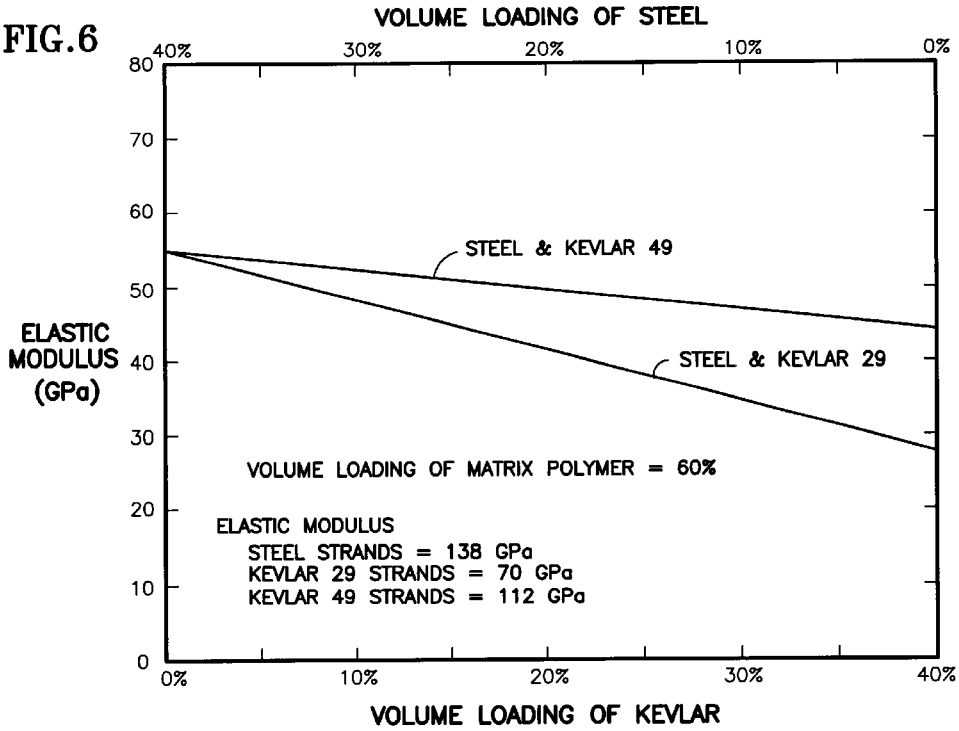
FIG. 6 is a graphic representation of elastic modulus of a tension member of the invention.

$V_m$=volume percent matrix 3 the change in elastic modulus is seen graphically in FIG. 6.

Figure 7:
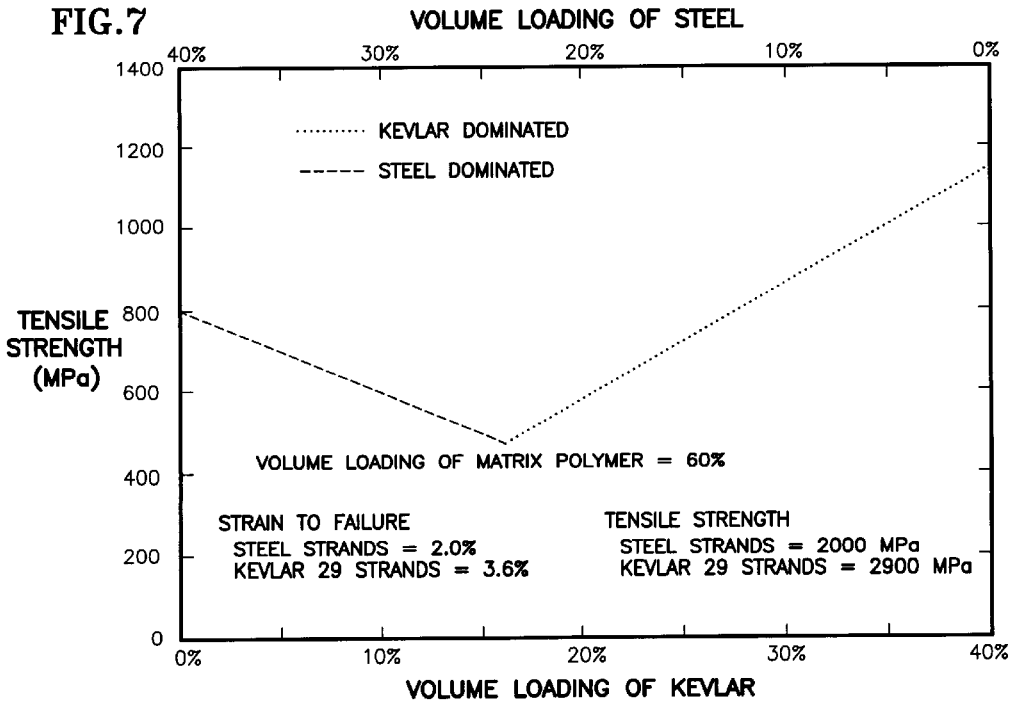
FIG. 7 is a graphic representation of strength of a tension member of the invention.

A calculation of the tensile strength of an exemplary tension member of the invention as a function of steel/organic fiber (e.g. Kevlar) content within the common coating of the tension member, i.e. the polyurethane coating in a preferred embodiment, is illustrated graphically in FIG. 7 where the volume percent of steel/Kevlar to the common coating material is maintained at 60 v/o (volume percent) but the percentage of steel and Kevlar relative to each other is varied.

The precise curve change point in the graph is at 24% steel and 16% Kevlar 29. (Value would vary for Kevlar 49.) To the right of the 24/16 point, Kevlar dominates the strength curve and to the left, steel dominates the strength curve. Steel fails at 2.0% strain while Kevlar fails at 3.6% strain. Where steel dominates, a failure of the steel due to strain will also cause the Kevlar to overload and fail. Where Kevlar dominates, however, a steel failure at 2.0% strain does not effect the failure of the Keviar which will hold until 3.6% strain.

At the changeover point of 24/16, the steel will retain sufficient strength in the tension member for service use of an elevator system employing such tension member after the Kevlar material has been deteriorated, has failed or has been destroyed. To achieve this result for different volume percentages of cord material to coating material the equation:

$$V_s \geqq (\sigma_k/\sigma_s)V_k$$

Where $V_s$=volume percent steel $V_k$=volume percent Kevlar $\sigma_s$=tensile strength steel $\sigma_k$=tensile strength Kevlar While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A tension member for interconnecting and providing a lifting force to a car and a counterweight of an elevator system comprising:

a plurality of steel and organic fiber load carrying members bearing the weight of the car and the counterweight; and a coating substantially enveloping said plurality of load carrying members and having an aspect ratio defined as a cross sectional width to thickness of the tension member of greater than one.

2. A tension member for providing a lifting force to a car of an elevator system as claimed in claim 1 wherein said plurality of load carrying members comprises a plurality of discrete steel load carrying members and a plurality of discrete organic fiber load carrying members.

3. A tension member for providing a lifting force to a car of an elevator system as claimed in claim 1 wherein said plurality of load carrying members comprises discrete hybrid cords having both steel and organic fiber material therein.

4. A tension member for providing a lifting force to a car of an elevator system as claimed in claim 3 wherein said cords comprise:

a core of steel; and an annulus of organic fiber.

5. A tension member for providing a lifting force to a car of an elevator system as claimed in claim 3 wherein said cords comprise:

a core of organic fiber; and an annulus of steel.

6. A tension member for providing a lifting force to a car of an elevator system as claimed in claim 3 wherein said cords comprise a plurality of strands which then are composed of a hybrid of wires of steel and organic fiber.

7. A tension member for providing a lifting force to a car of an elevator system as claimed in claim 1 wherein said steel load carrying member is in the form of a plurality of discrete cords and said organic fiber load carrying members are dispersed in said coating.

8. A tension member for providing a lifting force to a car of an elevator system as claimed in claim 7 wherein said organic fiber load carrying members are oriented in parallel with a longitudinal axis of the tension member.

* * * * *